US010354488B2

(12) United States Patent
Baron et al.

(10) Patent No.: US 10,354,488 B2
(45) Date of Patent: Jul. 16, 2019

(54) SYSTEMS, METHODS, AND DEVICES FOR DISPLAYING HISTORICAL ROULETTE INFORMATION

(71) Applicant: Bally Gaming, Inc., Las Vegas, NV (US)

(72) Inventors: Gabriel A. Baron, Henderson, NV (US); Todd M. Haushalter, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1355 days.

(21) Appl. No.: 13/631,598

(22) Filed: Sep. 28, 2012

(65) Prior Publication Data

US 2014/0094244 A1 Apr. 3, 2014

(51) Int. Cl.
*G07F 17/32* (2006.01)

(52) U.S. Cl.
CPC ..... *G07F 17/323* (2013.01); *G07F 17/3288* (2013.01)

(58) Field of Classification Search
CPC ..... G07F 17/323; G07F 17/3288
USPC ..... 463/17, 16, 30–33; 715/212
See application file for complete search history.

(56) References Cited

U.S. PATENT DOCUMENTS

| | | | | |
|---|---|---|---|---|
| 2,635,355 | A * | 4/1953 | Thompson et al. | 434/195 |
| 5,743,798 | A | 4/1998 | Adams et al. | |
| 6,059,659 | A | 5/2000 | Busch et al. | |
| 6,217,447 | B1 * | 4/2001 | Lofink et al. | 463/12 |
| 6,299,531 | B1 | 10/2001 | Bommarito | |
| 7,329,177 | B1 * | 2/2008 | Hui | 463/11 |
| 7,434,805 | B2 | 10/2008 | Grauzer et al. | |
| 8,070,582 | B2 | 12/2011 | Lutnick et al. | |
| 8,216,047 | B2 | 7/2012 | Bartosik | |
| 2006/0052154 | A1 * | 3/2006 | Boerner | 463/19 |
| 2007/0060262 | A1 | 3/2007 | Kosaka et al. | |
| 2008/0132311 | A1 | 6/2008 | Walker | |
| 2008/0132312 | A1 * | 6/2008 | Yoshizawa | 463/16 |
| 2008/0258383 | A1 | 10/2008 | Sorge | |

(Continued)

FOREIGN PATENT DOCUMENTS

WO WO 2010046756 A2 * 4/2010

OTHER PUBLICATIONS http://www.rouletteforum.cc/index.php?topic=4975.0, posted Apr. 28, 2011-Jun. 30, 2011 by various posters, with attached spreadsheet—"Roulette—All Decisions-Color-Automatic (Random and Manual with Streets).xlsx" posted Apr. 30, 2011.*

(Continued)

*Primary Examiner* — David L Lewis
*Assistant Examiner* — Ross A Williams
(74) *Attorney, Agent, or Firm* — TraskBritt

(57) ABSTRACT

Methods and apparatuses for displaying information relating to a roulette game. A roulette game display comprises at least one of a hot bet field, a number frequency field, and an even-money bet road chart. The hot bet field displays a message including information relating to a highest ranking event stored in an event history. The number frequency field includes an arrangement of indicator spaces configured for marking to show recent results of a plurality of roulette wheel spins. The even-money bet road chart includes a grid for displaying a plurality of recently winning even-money bets.

24 Claims, 8 Drawing Sheets

(56) References Cited

U.S. PATENT DOCUMENTS

| | | | | |
|---|---|---|---|---|
| 2009/0102125 | A1 | 4/2009 | Segebarth et al. | |
| 2010/0124967 | A1 | 5/2010 | Lutnick et al. | |
| 2010/0148442 | A1* | 6/2010 | Walker et al. | 273/274 |
| 2011/0111825 | A1 | 5/2011 | Caputo | |
| 2011/0223983 | A1 | 9/2011 | Schwartz et al. | |
| 2012/0157193 | A1 | 6/2012 | Arezina et al. | |

OTHER PUBLICATIONS

Solitude, John, "Wheel Frequency Analysis", May 2003.*
TCSJohnHuxley, "New e-FX Displays," <<http://www.tcjohnhuxley.com/en/displays/new-e-fx-displays.html>> 2012, 2 pages.
Wizard of Odds, "Baccarat Score Boards," <<http://wizardofodds.com/games/baccarat/history/>> 1998, 5 pages.
PCT International Search Report and Written Opinion of the International Searching Authority for PCT/US13/61706, dated Jun. 13, 2014, 24 pages.
International Preliminary Report on Patentability for International Application No. PCT/US2013/061706, dated Mar. 31, 2015, 9 pages.
Australian Examination Report for Australian Application No. 2013323592 dated May 3, 2017, 7 pages.
Australian Examination Report for Australian Application No. 2013323592 dated Aug. 29, 2017, 6 pages.
Canadian Office Action from Canadian Application No. 2,888,105, dated Sep. 28, 2018, 6 pages.

* cited by examiner

SYSTEMS, METHODS, AND DEVICES FOR DISPLAYING HISTORICAL ROULETTE INFORMATION

FIELD

Embodiments of the present disclosure relate to systems and methods for displaying historical information in relation to games of roulette.

BACKGROUND

Conventionally, roulette is a table game that includes a roulette wheel and a roulette betting table. FIG. 1A illustrates a simplified view of a conventional roulette wheel 100 of the type used in the United States, and FIG. 1B illustrates a simplified view of a corresponding, conventional roulette betting table 101. The roulette wheel of FIG. 1A shows an American style roulette wheel, comprising pockets 102 numbered one (1) through thirty-six (38). The roulette wheel 100 also includes a pocket 108 numbered zero (0), and a pocket 110 numbered double zero (00). Half the numbered pockets 102 are red pockets 104, and half the numbered pockets 102 are black pockets 106, as shown in FIG. 1. The zero pocket 108 and the double zero pocket 110 are green. Zero pocket 108 and double zero pocket 110 provide casinos a house advantage. European style roulette wheels are similar to the American style roulette wheel 100 of FIG. 1A, but include only thirty-seven (37) numbered pockets 102, and do not include the double zero pocket 110.

The roulette betting table 101 includes a plurality of betting spaces 112. The plurality of betting spaces 112 includes a plurality of single-number betting spaces 114 corresponding to each of the numbered pockets 102, which are arranged into three columns and twelve rows. The betting table 101 also includes a single betting space corresponding to the zero pocket 108 and a single betting space corresponding to the double zero pocket 110. The betting table also includes a plurality of descriptive betting spaces 116. The plurality of descriptive betting spaces 116 includes three two-to-one betting spaces 130, each being disposed at the end of one of the three columns of single number betting spaces 114. The plurality of descriptive betting spaces 116 further includes three betting spaces corresponding respectively to the "1st 12" of the numbered pockets 102, the "2nd 12" of the numbered pockets 102, and the "3rd 12" of the numbered pockets 102. Accordingly, the 1st 12 betting space is located beside the first four rows of the single-number betting spaces 114, the 2nd 12 betting space is located beside the middle four rows of the single-number betting spaces 114, and the 3rd 12 betting space is located beside the last four rows of the single-number betting spaces 114.

The plurality of descriptive betting spaces 116 further includes six even-money betting spaces 132. The even-money betting spaces 132 include a "LOW" betting space 118 (which corresponds to the lower half of the numbered pockets 102, which are those numbered one (1) through eighteen (18)), a "HIGH" betting space 120 (which corresponds to the upper half of the numbered pockets 102, which are those numbered nineteen (19) through thirty-six (36)), an "EVEN" betting space 122 (corresponding to the even numbered pockets 102), an "ODD" betting space 124 (corresponding to the odd numbered pockets 102), a red betting space 126 (corresponding to the red pockets of the numbered pockets 102), and a black betting space 128 (corresponding to the black pockets of the numbered pockets 102).

In a roulette game, a player may place one or more bets by placing wagers in the form of money or chips in any of the betting spaces 112, along lines between the betting spaces 112 which are characterized as "splits," or at the intersections of lines between the betting spaces 112, which are characterized as "boxes." As non-limiting examples, possible bets include a single number bet, a split bet (a bet placed on a line between two adjacent single-number betting spaces 114), a corner bet (a bet placed at the point at which two perpendicular lines intersect between at the adjacent corners of four single-number betting spaces 114), a three number street bet (a bet placed beside one of the sixteen rows of three single-number betting spaces 114 on a line extending alongside the sixteen rows of three single-number betting spaces 114), a basket bet (a bet placed on the bottom left corner of the number 1, which comprises a wager covering 0, 00, 1, 2 and 3 and which pays 6 to 1), and a double street bet (a bet placed at the bottom of the layout between two numbers, for example 1 and 4, that wagers on the six numbers above and which pays 5 to 1). Other bets include the zero bet, the double zero bet, any of the three "2 to 1" bets, the "1st 12" bet, the "2nd 12" bet, the "3rd 12" bet, and any of the even money bets (LOW, HIGH, RED, BLACK, ODD, and EVEN). Some bets are less commonly made by players compared to others during roulette game play. For example, red and black bets are relatively common, whereas high and low bets are relatively uncommon.

To play roulette, bets are placed by players on the roulette betting table 101. A croupier spins the roulette wheel 100 in a first rotational direction, and then spins a ball in the opposite rotational direction on an inclined surface 103 of the roulette wheel 100. The ball comes to rest in one of the pockets 102, after which all wagers are settled by the croupier.

The greater the number of single-number betting spaces 114 included in a bet, the higher the probability that a player will win. The payout a winning bet receives is lower for a higher probability win, and the payout is higher for a lower probability win. For example, a single-number bet has a relatively low probability (1/38) of winning, so the payout is relatively high. As another example, an even-money bet has a relatively high probability (18/38) of winning, so the payout is relatively low.

Successful casino games give players the appearance of an advantage. For example, the revolutionary card game "LET IT RIDE®" allows players to retract a wager previously made, which gives the appearance of an advantage.

BRIEF SUMMARY

Embodiments of the present disclosure include methods and apparatuses for displaying historical results in roulette game play.

In some embodiments, the present disclosure comprises a method of displaying information relating to a roulette game. The method includes displaying a grid on a display, the grid comprising a plurality of indicator spaces arranged in a plurality of lines in a first direction and a plurality of lines in a second direction. The plurality of lines in the first direction includes a first line in the first direction and a last line in the first direction, and the plurality of lines in the second direction includes a first line in the second direction and a last line in the second direction. The method also includes displaying an initial indicator in an initial indicator space, the initial indicator corresponding to one of a first indicator and a second indicator. The first indicator signals a first winning bet of an even money bet, and the second indicator signals a second winning bet of the even money bet. The method further includes displaying a subsequent indicator in a subsequent indicator space. The subsequent indicator corresponds to a subsequent winning bet of the even money bet. The subsequent indicator is located in an indicator space adjacent to a preceding indicator space, and in the same line in the second direction as a preceding indicator space if the subsequent indicator is the same as a preceding indicator in the preceding indicator space. The subsequent indicator is located in an indicator space in the first line in the first direction and in an empty line in the second direction adjacent to the preceding indicator space if the subsequent indicator is not the same as the preceding indicator.

In other embodiments, the present disclosure comprises an apparatus for displaying information relating to a roulette game including a grid. The grid includes a plurality of lines in a first direction including a first line in the first direction and a last line in the first direction. The grid also includes a plurality of lines in a second direction substantially perpendicular to the plurality of lines in the first direction. The plurality of lines in the second direction includes a first line in the second direction and a last line in the second direction. The grid further includes a plurality of indicator spaces arranged in the plurality of lines in the first direction and the plurality of lines in the second direction. Each of the plurality of indicator spaces is configured to display a plurality of indicators corresponding to a plurality of winning bets in a roulette game. A first indicator corresponds to a first bet of an even money bet. A second indicator corresponds to a second bet of the even money bet. The grid is configured to display one of the first indicator and the second indicator corresponding to an initial winning bet of the even money bet of an initial spin of a roulette wheel in an initial indicator space. The grid is further configured to display a subsequent indicator in a subsequent indicator space. The subsequent indicator corresponds to a subsequent winning bet. The subsequent indicator space is located in an indicator space adjacent to a preceding indicator space and in the same line in the second direction as the preceding indicator space if the subsequent indicator is the same as a preceding indicator in the preceding indicator space. The subsequent indicator space is located in the first line in the first direction and in a next line in the second direction with an empty indicator space in the first line in the first direction if the subsequent indicator does not match the preceding indicator.

In other embodiments, the present disclosure comprises a display for providing information relating to a roulette game. The display includes a storage device configured to store a plurality of possible roulette events. Each of the plurality of possible roulette events comprises one of a plurality of possible winning bets occurring at one of a plurality of frequencies of occurrence. The plurality of possible winning bets comprises at least one even money bet. Each of the plurality of possible winning bets is assigned a ranking of a plurality of descending rankings. The storage device is further configured to store a plurality of past roulette events as they occur. The display includes a highest ranking message field within a display. The highest ranking message field is configured to display a message responsive to the occurrence of at least one roulette event of the plurality of possible roulette events. The message includes information corresponding to a highest ranking roulette event of the plurality of past roulette events stored in the event history.

In other embodiments, the present disclosure comprises a method of displaying information relating to a roulette game. The method includes storing a plurality of possible roulette events on a storage device. Each of the plurality of possible roulette events includes at least one of a plurality of possible winning bets occurring at one of a plurality of possible frequencies of occurrence. Each of the plurality of possible roulette events is assigned a ranking. The method includes recording a plurality of actual roulette events resulting from a predetermined number of recent spins of a roulette wheel on the storage device as each of the actual roulette events occur. The method includes displaying information about a highest ranking event of the plurality of actual roulette events in a highest ranking event field within a display.

In other embodiments, the present disclosure comprises a display device for displaying information relating to a roulette game. The display device includes a field including an arrangement of indicator spaces. Each of the indicator spaces includes a number corresponding to a number on a roulette wheel. The arrangement of indicator spaces is configured for marking to indicate a plurality of results corresponding to a predetermined number of spins of the roulette wheel.

In other embodiments, the present disclosure comprises a method of displaying information relating to a roulette game. The method includes displaying a plurality of indicator spaces in a field of a display device. Each of the plurality of indicator spaces displays a number corresponding to each of the numbers on a roulette wheel. The method includes storing a plurality of results corresponding to a plurality of spins of a roulette wheel on a storage device. The method includes marking each of the plurality of indicator spaces that correspond to the plurality of results.

DETAILED DESCRIPTION

Figure 1A:
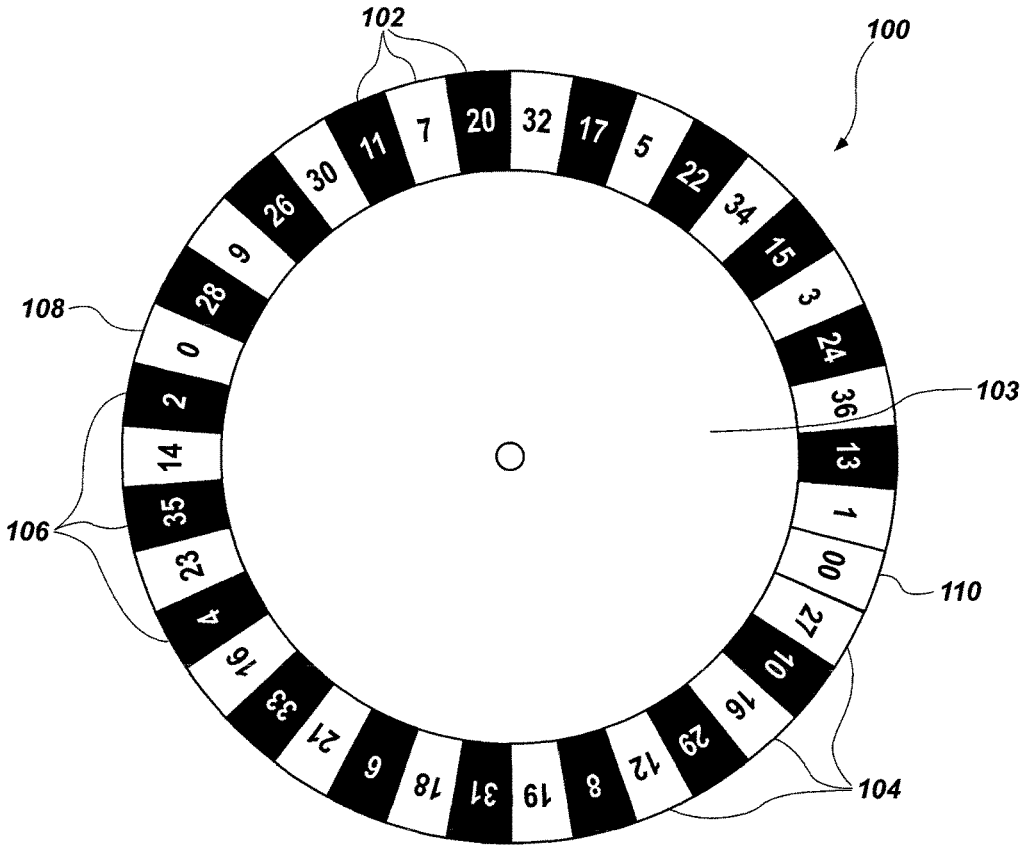
FIG. 1A (PRIOR ART)
FIG. 1A is a simplified view of a conventional roulette wheel.
Figure 1B:
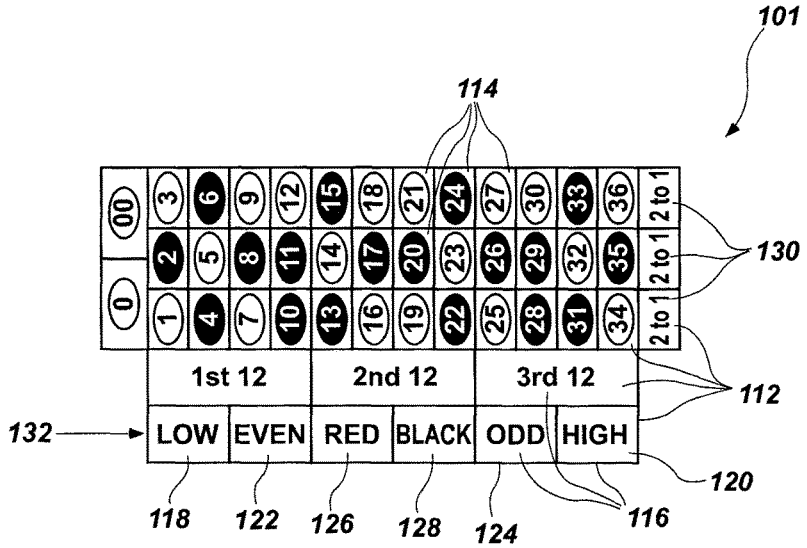
FIG. 1B (PRIOR ART)
FIG. 1B is a simplified view of a conventional roulette betting table felt.

In the following detailed description, reference is made to the accompanying drawings which form a part hereof, and in which is shown by way of illustration, specific embodiments in which the disclosure may be practiced. These embodiments are described in sufficient detail to enable those of ordinary skill in the art to practice in accordance with the disclosure. It should be understood, however, that the detailed description and the specific examples, while indicating embodiments, are given by way of illustration only and not by way of limitation. From this disclosure, various substitutions, modifications, additions, rearrangements, or combinations thereof within the scope of the present invention may be made and will become apparent to those of ordinary skill in the art.

In accordance with common practice, the various features illustrated in the drawings may not be drawn to scale. The illustrations presented herein are not meant to be actual views of any particular method, device, or system, but are merely idealized representations that are employed to describe various embodiments of the present disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or method. In addition, like reference numerals may be used to denote like features throughout the specification and figures.

Information and signals described herein may be represented using any of a variety of different technologies and techniques. For example, a roulette wheel may include any one or combination of an actual physical roulette wheel, a roulette wheel implemented with computer software, or a roulette wheel implemented with an electric circuit. Also, a roulette wheel spin may include spinning an actual roulette wheel manually or automatically, launching a ball manually or automatically, or obtaining a spin result through a computer software or electric circuit implemented roulette spin.

In some embodiments, a roulette game display as described herein may be implemented as electronic hardware, computer software, or combinations of both. To clearly illustrate this interchangeability of hardware and software, various illustrative components, blocks, modules, circuits, and acts are described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the embodiments of the invention described herein. In additional embodiments, a roulette game display as described herein may be implemented as a sign to be updated manually by a display operator.

In addition, it is noted that the embodiments may be described in terms of a process. Although a process may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on a computer-readable medium. Computer-readable media includes both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise, a set of elements may comprise one or more elements.

Elements described herein may include multiple instances of the same element. These elements may be generically indicated by a numerical designator (e.g. 110) and specifically indicated by the numerical indicator followed by an alphabetic designator (e.g., 110A) or a numeric indicator preceded by a "dash" (e.g., 110-1). For ease of following the description, for the most part, element number indicators begin with the number of the drawing on which the elements are introduced or most fully discussed Embodiments of the present disclosure include methods and devices that display historical game play information during roulette game play.

Figure 2:
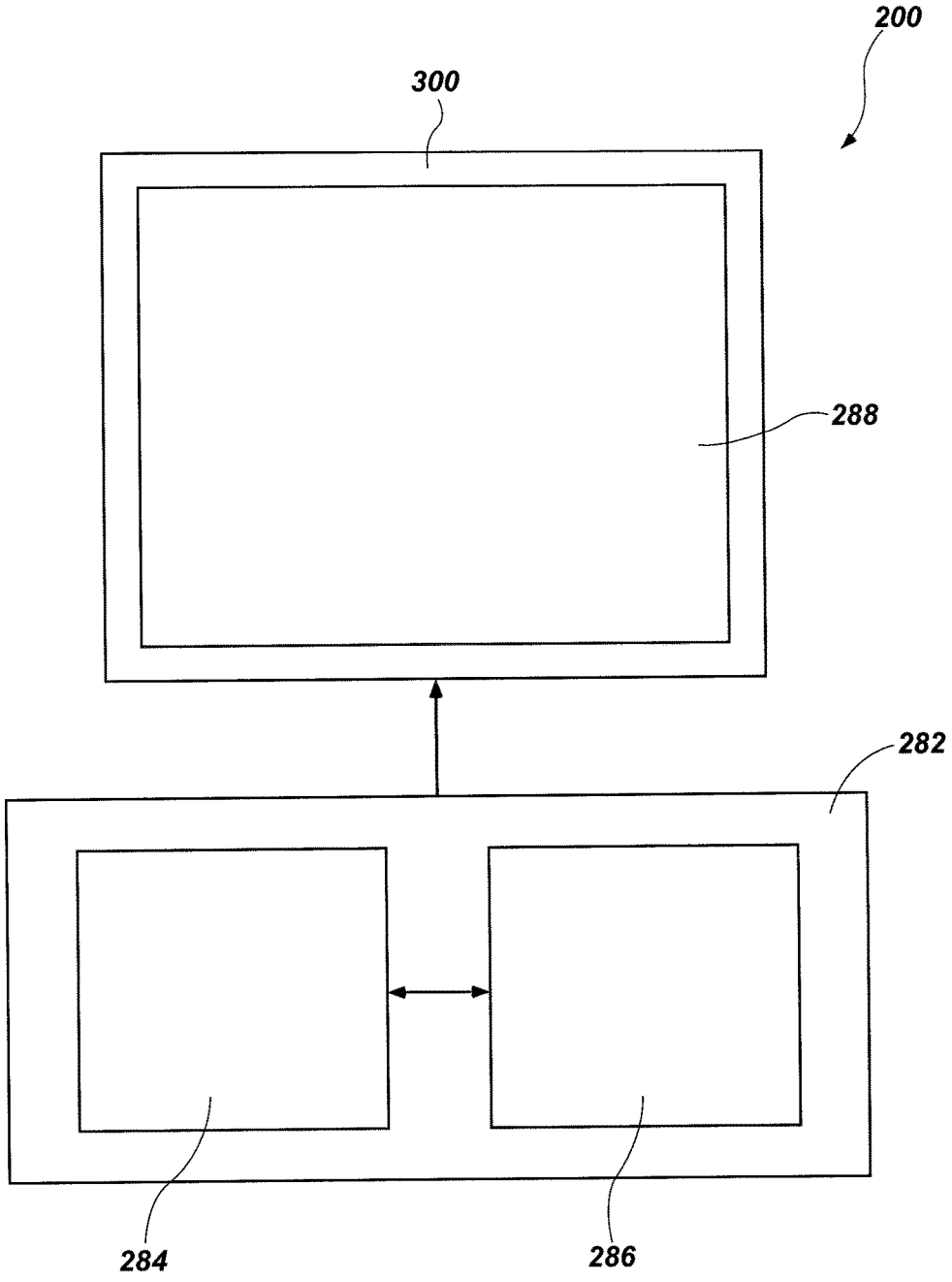
FIG. 2 is a simplified block diagram of a display system for displaying historical roulette game play information.

FIG. 2 illustrates a simplified block diagram of a display system 200 for displaying historical roulette game play information. The display system 200 includes a roulette game display 300 and a control circuit 282. The roulette game display 300 and the control circuit 282 may be incorporated into a single device or, alternatively, in separate devices. In other words, the control circuit 282 may be embedded within the game display 300, or the control circuit 282 may be separate from the display 300 and operably coupled therewith. For example, in some embodiments, the control circuit 282 may comprise a computer separate from the display 300 and configured to control operation thereof. The roulette game display 300 includes a screen 288 for displaying historical roulette game play information.

The control circuit 282 comprises at least a processor 284 operably coupled to a storage device 286. The control circuit 282 is configured to operably couple to and control the roulette game display 300. The control circuit 282 is further configured to store historical roulette game play information on the storage device 286. The storage device 286 may include any of a random access memory, a computer readable media, a flash memory, and an erasable programmable read only memory, etc. The control circuit 282 is further configured to direct the roulette game display 300 to display the historical roulette game play information on the screen 288, according to embodiments of the current invention. Historical game play information stored in storage device 286 may be obtained from a gaming device such as is offered under the brand names i TABLE ROULETTE®, RAPID ROULETTE® and VEGAS STAR ROULETTE® by Shuffle Master, Inc., of Las Vegas, Nev., assignee of the present invention.

Figure 3A:
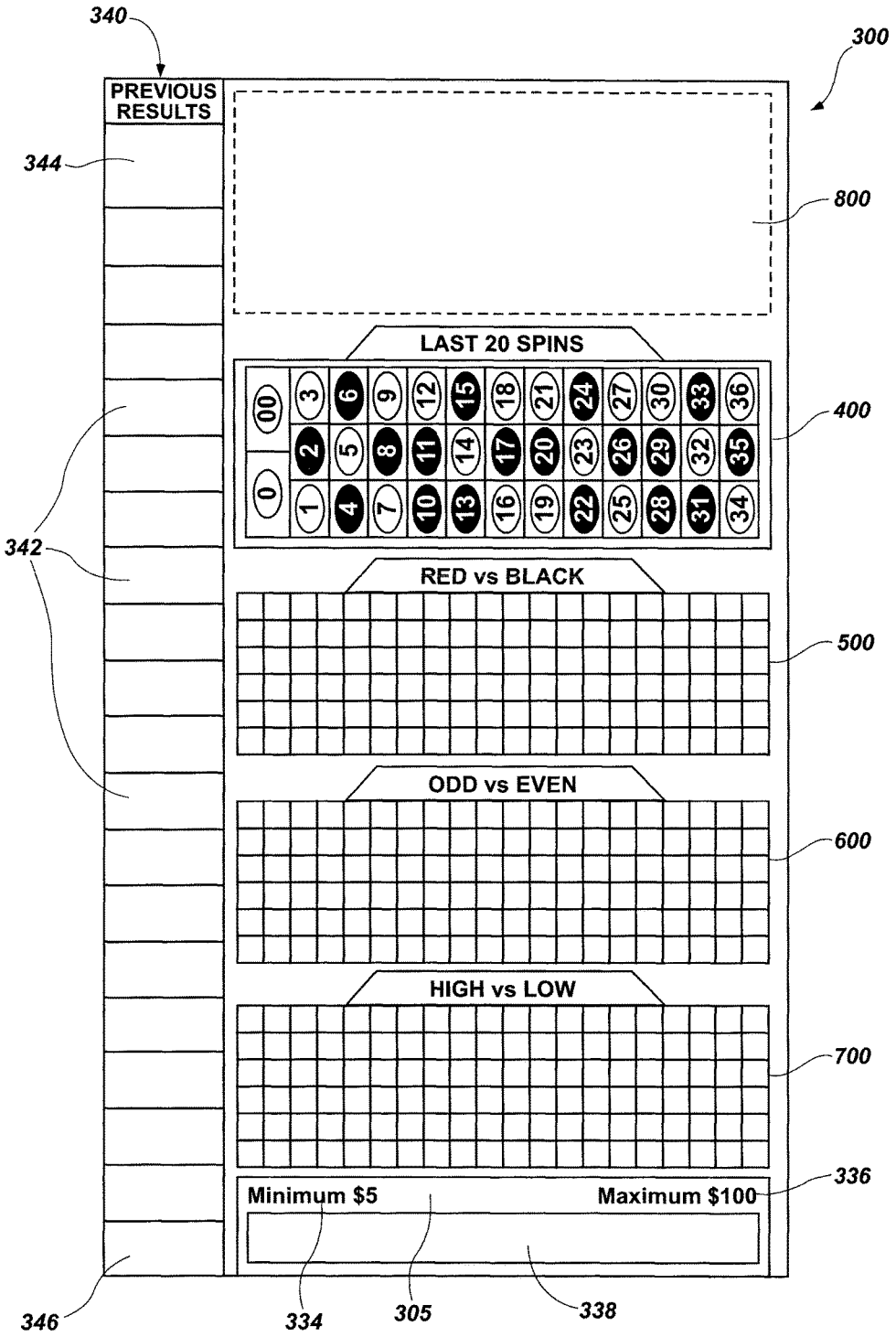
FIG. 3A is a simplified schematic illustration of an un-populated roulette game display for displaying historical roulette game play information.

FIG. 3A illustrates a simplified plan view of the roulette game display 300. The roulette game display 300 illustrated in FIG. 3A includes a screen 288 (FIG. 2) or other device on which an electronic image may be displayed. As non-limiting examples, the roulette game display 300 may comprise a light-emitting diode display, a liquid crystal display, a plasma display, a cathode ray tube display, etc. The roulette game display 300 may alternatively be implemented as a mechanical display, or any other type of device suitable for displaying information as described herein.

While a primary purpose of the roulette game display 300 is to display historical game play information, the roulette game display 300 optionally may also be used to display additional information. For example, a region 305 of the roulette game display 300 may be configured to display information relating to the roulette game being played. For example, the roulette game display 300 may include, in region 305, a minimum bet field 334 for displaying a minimum bet that may be wagered and a maximum bet field 336 for displaying a maximum bet that may be wagered. As another example, the roulette game display 300 optionally may include a message field 338 for displaying messages to players, which messages may be customizable by a casino. Such messages may include, for example, advertisements, and comp awards, and may also be used to communicate guest information, such as reminder to pick up show tickets, and ticket office locations. The message field 338 may be configured as a scrolling message field, or a stationary message field.

The roulette game display includes different regions for displaying different forms of historical game play information. The roulette game display 300 includes a previous results field 340, configured to display a plurality of results of previous roulette wheel 100 spins. The previous results field 340 comprises a predetermined number of previous results indicator spaces 342, each configured to display a previous result from the plurality of previous roulette wheel 100 spins. In the embodiment pictured in FIG. 3A, the previous results field 340 shows twenty previous results indicator spaces 342 arranged in a vertical column, including a most recent result indicator space 344 at the top of the vertical column, and a least recent result indicator space 346 at the bottom of the column. In the embodiment of FIG. 3A, the most recent result indicator space 344 is enlarged to differentiate the most recent result indicator space 344 from the rest of the recent result indicator spaces. Those of ordinary skill in the art would appreciate that many other configurations may be used to display the plurality of results of previous roulette wheel 100 spins.

The roulette game display 300 also includes what is referred to herein as a "hot" bet field 800. The hot bet field 800 is configured to display a message 810 to players corresponding to a highest ranking roulette event of a predetermined number of roulette events stored in an event history that is stored on the storage device 286 after each spin of the roulette wheel. The processor 284 of the control circuit 282 is configured to direct the storage device 286 to store roulette events as they occur in the event history. The event history may be limited to hold a predetermined number of roulette events that result from sequential roulette wheel 100 spins. In some embodiments the event history may be limited to storing the twenty most recent events. In other embodiments, the limit on the event history may be higher or lower.

The possible roulette events include possible winning bets occurring at different frequencies of occurrence. Each roulette event is assigned a ranking in computer software stored in the storage device 286 and executed by the control circuit 282 using the processor 284 and the storage device 286. In at least one embodiment of the present disclosure, a plurality of possible roulette events may include the possible winning bets at frequencies of occurrence and ranking as listed in TABLE 1, as follows:

TABLE 1

| Column 1<br>Possible Winning Bets | Column 2<br>Frequencies of Occurrence | Column 3<br>Rank |
|---|---|---|
| Same single number | 3+ consecutive | 1 |
| Any two number split (e.g., 17-16, 16-17) | 4+ consecutive | 2 |
| Any numbers included in a 3 number street bet (e.g., 1, 3, 2) | 4+ consecutive | 3 |
| Any numbers included in a 4 number corner bet (e.g., 1, 4, 5, 2) | 4+ consecutive | 4 |
| Any two-to-one payout combined with a different winning bet (e.g., 13, 21, 16, 24) | 4+ consecutive | 5 |
| Any even money wager (Even/Odd, High/Low, Red/Black) | 5+ consecutive | 6 |
| Any even money wager (Even/Odd, High/Low, Red/Black) | 4 consecutive | 7 |
| Any two number split (e.g., 17, 16, 16, 17) | 3 consecutive | 8 |
| Any numbers included in a 3 number street bet (e.g., 1, 3, 2) | 3 consecutive | 9 |
| Any numbers included in a 4 number corner bet (e.g., 1, 4, 5, 2) | 3 consecutive | 10 |
| Any 2-1 payout which has a result within it (e.g., 13, 21, 16, 24) (Dozens displayed before columns) | 3 consecutive | 11 |
| Any even money wager (Even/Odd, High/Low, Red/Black) | 3 consecutive | 12 |
| Same single number | 2 consecutive | 13 |
| Same single number | 3 out of last 4 | 14 |
| Same single number | 3 out of last 5 | 15 |
| Same single number | 3 out of last 6 | 16 |
| Any two-to-one payout combined with a different winning bet (e.g., 13, 21, 16, 24) | 5 out of last 6 | 17 |
| Any two-to-one payout combined with a different winning bet | 4 out of last 5 | 18 |

TABLE 1-continued

| Column 1 Possible Winning Bets | Column 2 Frequencies of Occurrence | Column 3 Rank |
|---|---|---|
| Any two-to-one payout combined with a different winning bet (e.g., 13, 21, 16, 24) | 4 out of last 6 | 19 |
| Any even money wager (Even/Odd, High/Low, Red/Black) | 5 out of last 6 | 20 |
| Any even money wager (Even/Odd, High/Low, Red/Black) | 4 out of last 5 | 21 |
| Any even money wager (Even/Odd, High/Low, Red/Black) | 4 out of last 6 | 22 |

TABLE 1 includes three columns. Each horizontal row in TABLE 1 represents a possible roulette event. Column 1 of TABLE 1 represents a list of possible winning bets. Column 2 of TABLE 1 represents a list of possible frequencies of occurrence corresponding to the winning bets of column 1. Column 3 of TABLE 1 represents rankings that may be assigned to the possible roulette events, wherein lower number represent a higher ranking. In other words, the roulette event of the first row (3 or more consecutive occurrences of the same single number) is assigned the highest ranking of "1," and the roulette event of the last row (4 out of the last 6 roulette spins including any single even money wager) is assigned the lowest ranking of "22." Of course, other possible roulette events may be identified and included in the list, and the rankings for each of the possible roulette events may be arbitrarily assigned as desirable by a casino or other gaming operator.

The list of possible winning bets may include any of the bets that may be wagered in the roulette game. In some embodiments, the list of possible winning bets may include all of the bets that may be wagered in the roulette game. Subsets of all winning bets may be included in other embodiments The frequencies of occurrence, as shown in Column 2 of TABLE 1, may include numbers representing consecutive occurrences, or numbers representing a number within a predefined number of previous spins.

In some embodiments, the rankings for the possible roulette events may be ordered based on their mathematical probability of occurrence. In other words, roulette events that have lower mathematical probabilities of occurrence may be assigned higher rankings than possible roulette events having higher mathematical probabilities of occurrence. In other embodiments, rankings may be assigned based on casino preference, customer preference, by the frequency of wagers made, or other criteria.

After each spin of the roulette wheel 100, the computer software executed by the control circuit 282 may determine which of the possible roulette events in TABLE 1 are satisfied. The criteria for zero, one, or a plurality of the possible roulette events may be satisfied after a roulette spin.

As a roulette game progresses, each spin of the roulette wheel 100 results in updating the event history and displaying a message 810, which may correspond to the highest ranking roulette event stored in the event history for which the criteria therefore is satisfied, in the hot bet field 800.

The roulette game display 300 also includes a number frequency field 400, a red vs. black road chart 500, an odd vs. even road chart 600, and a high vs. low road chart 700, each as described in more detail with reference to FIGS. 4A through 7C below. Other embodiments of the roulette game display 300 may include one or more of the hot bet field 800, the number frequency field 400, the red vs. black road chart 500, the odd vs. even road chart 600, and the high vs. low road chart 700, in any combination. Further, the arrangement and location of the various fields and charts included in the display may be different than is shown in the non-limiting example shown in the figures.

Figure 3B:
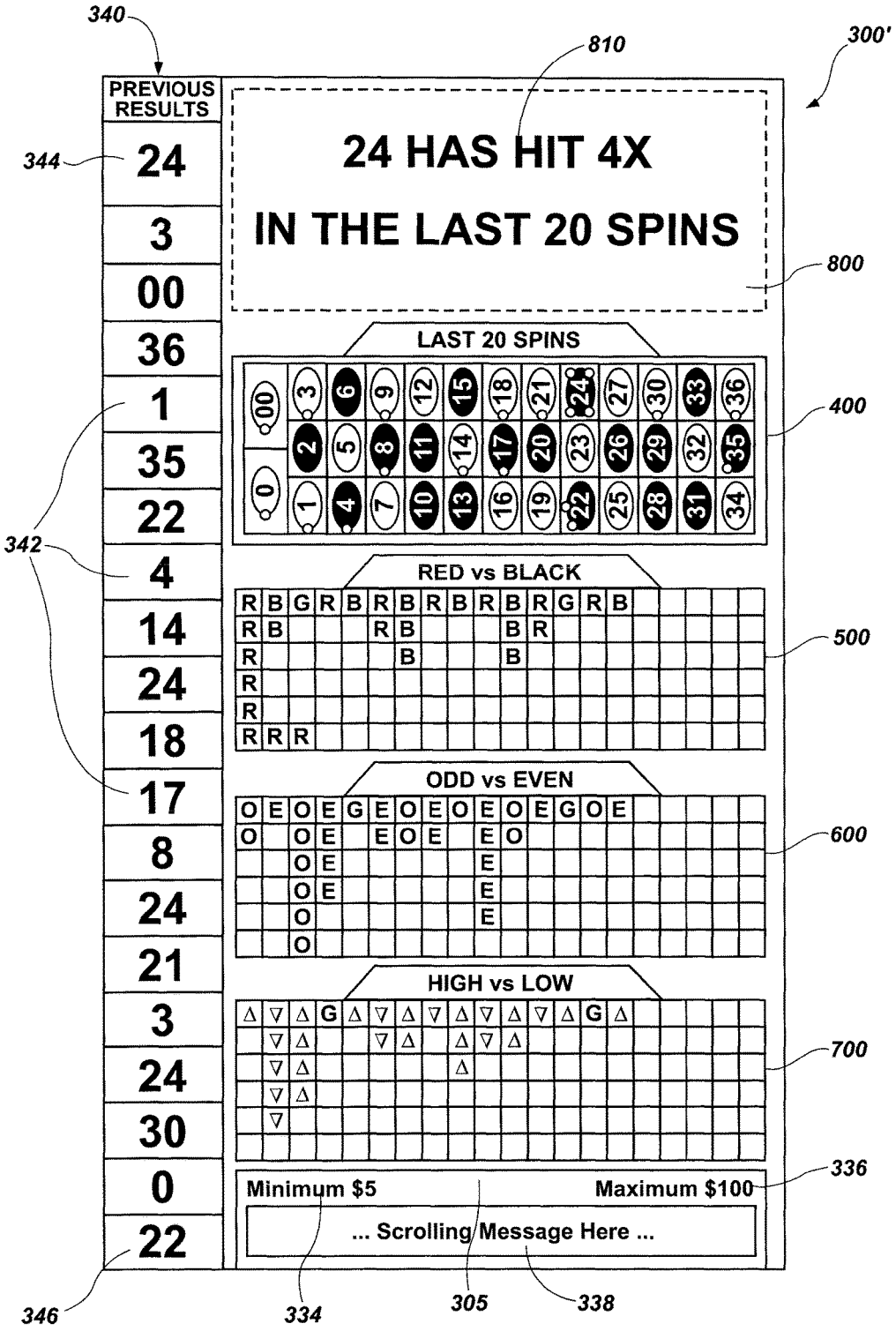
FIG. 3B illustrates the roulette game display of FIG. 3A populated with an example of historical game play information.

FIG. 3B illustrates the roulette game display 300' of FIG. 3A populated with hypothetical historical game information. The roulette game display 300' shows the results of the previous twenty spins of the roulette wheel 100 in the previous results indicator spaces 342 of the previous results field 340. The hot bet field 800 in the roulette game display 300' displays the message 810, in FIG. 3B illustrating a summary of results shown in the previous results indicator spaces 342 of previous results field 340 that "24 HAS HIT 4× IN THE LAST 20 SPINS," corresponding to, for example, one or more of the highest ranking roulette event stored in the event history. If equally ranked events are stored in the event history of the storage device 286, the processor 284 of control circuit 282 (FIG. 2) may be programmed to select the highest number of the same events stored in the event history, the number of same events within a given range of events less than the number stored within the event history, the number of same events in the last five, last ten or other number of events less than the number of events stored within the game history, or other criteria for selection of a hot bet message to display.

As another example, the message 810 may read "24 HAS HIT 3× IN THE LAST 4 SPINS" upon the occurrence of three 24s in the last four spins and as displayed in the previous results field 340, conveying an urgency to players that 24 is currently the "hot" number.

It should be noted that there is a small percentage of time, for example six percent (6%), when no ranked events will be occurring to cause population of the hot bet field 800 on roulette game display 300 with an appropriate, corresponding hot bet message 810. In such an instance, the hot bet field 800 may be caused to display a message 810 in the form of a piece of general artwork to fill the hot bet field 800. Thus, when no ranked events are occurring, the hot bet field 800 may display a simple roulette wheel animation, a game logo, a casino logo or other appropriate graphics as a message 810. As another alternative, an "attract" message may be displayed, just as money (bills, coins) falling from the sky, bricks of gold bullion stacking into a pyramid, a treasure chest opening and spilling gold coins, etc.

The number frequency field 400, the red vs. black road chart 500, the odd vs. even road chart 600, and the high vs. low road chart 700, are each populated, as well, as described in more detail with reference to FIGS. 4A through 7C below, in correspondence with the previous results field 340 and the hot bet display field 800.

The number frequency field 400 includes an arrangement of indicator spaces 450. Each of the indicator spaces 450 comprises a number corresponding to a number on the roulette wheel. The arrangement of indicator spaces 450 is configured for marking to indicate a plurality of results corresponding to a predetermined number of spins of the roulette wheel 100. In the embodiment of FIG. 3B, the number frequency field 400 is configured to display the results of the previous twenty spins of the roulette wheel 100 in a dots-on-number configuration 400' over a representation of the number portion of the betting table.

Figure 4A:
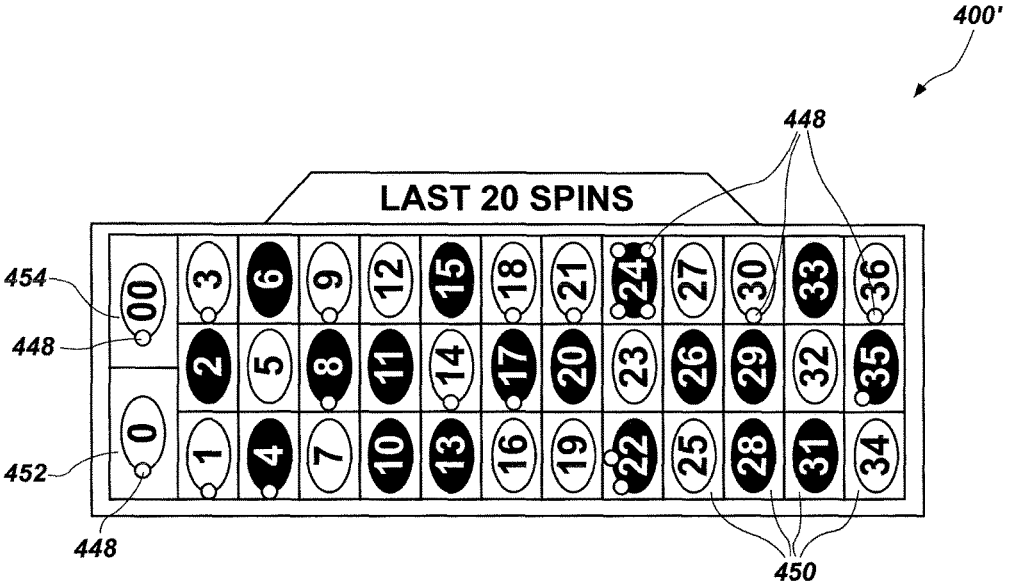
FIG. 4A is a plan view of a number frequency field in a dots-on-number configuration that may be displayed on a portion of the roulette game display of FIGS. 3A and 3B.

FIG. 4A is an enlarged view of the number frequency field 400 shown in FIG. 3B. The dots-on-number configuration 400' includes the indicator spaces 450 arranged in a roulette table layout configuration. Responsive to each spin of the roulette wheel 100, the indicator space 450 corresponding to the result of each spin is marked by displaying a marker 448 on the corresponding indicator space 450. In the embodiment of FIG. 4A, for example, two of the last twenty spins resulted in the numbered pocket 22.

A zero indicator space 452 and a double zero indicator space 454 may also be configured to be marked by the markers 448 responsive to spins of the roulette table resulting in the zero pocket 108 and the double zero pocket 110, respectively.

Figure 4B:
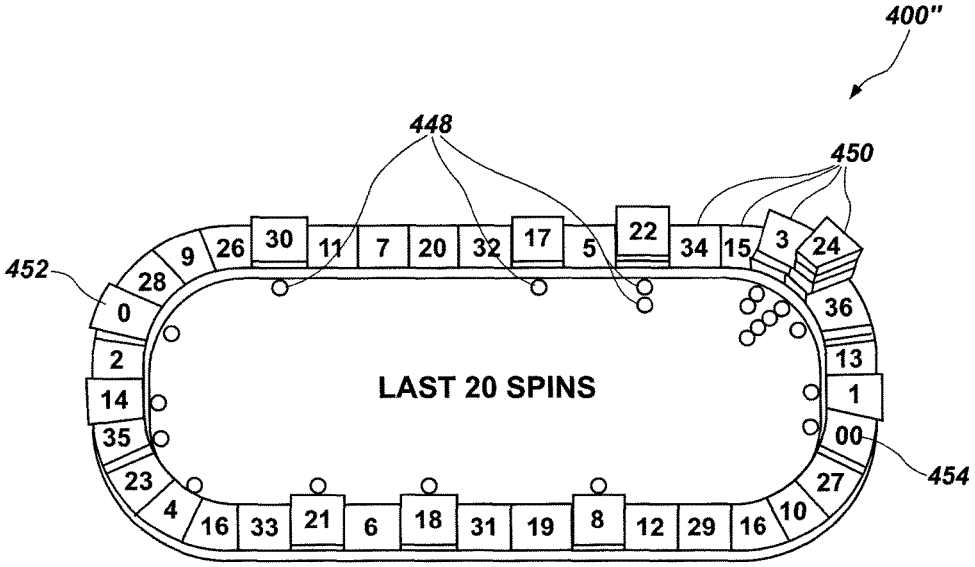
FIG. 4B is a plan view of a number frequency field in a circular "racetrack" configuration which may be displayed on a portion of the roulette game display of FIGS. 3A and 3B.

In additional embodiments, the number frequency field 400 of the display 300 may have other configurations. For example, FIG. 4B illustrates a simplified view of a number frequency field 400 in a racetrack configuration 400". In the racetrack configuration 400" the indicator spaces 450 are arranged in an elongated ring. Each indicator space 450 may be configured to be marked by locating a plurality of markers 448 next to the indicator spaces 450, as shown in FIG. 4B. The indicator spaces 450 are marked by placing a marker 448 next to the indicator space 450 that corresponds to a result of a spin of the roulette wheel 100. A zero indicator space 452 and a double zero indicator space 454 may also be configured to be marked by the markers 448 responsive to spins of the roulette table resulting in the zero pocket 108 and the double zero pocket 110, respectively. The markers 448 may be limited in number, and with each spin of the roulette wheel, a new marker may be added and the marker that has been displayed the longest may be removed.

The indicator spaces 450 may alternatively or additionally be marked by displaying the indicator spaces 450 as having additional indicator spaces stacked on top of one another to represent the frequency with which those numbers have hit. In the embodiment of FIG. 4B, for example, two additional indicator spaces are stacked on top of the indicator space corresponding to a numbered pocket 22, indicating two recent spins resulted in numbered pocket 22.

In some embodiments, the number frequency field 400 of the display 300 may periodically switch between different configurations, such as the betting table layout of FIG. 4A and the racetrack layout of FIG. 4B.

FIGS. 5A through 7C are described below with reference to columns and rows of indicator spaces. The rows and columns of indicator spaces may also be characterized generically as "lines." The description refers to columns of indicator spaces as vertically oriented, and rows of indicator spaces as horizontally oriented. The orientation of columns and rows, however, depends on perspective and orientation of the fields within roulette game display. Columns may equally be oriented in a horizontal manner, and rows in a vertical manner, within the scope of the present disclosure.

Figure 5A:
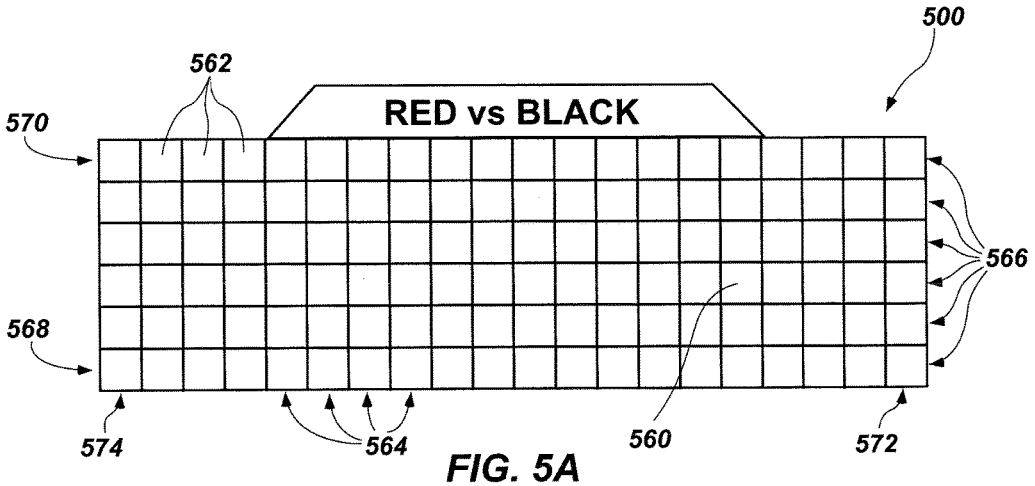
FIG. 5A is a plan view of an unpopulated red vs. black road chart that may be displayed on a portion of the roulette game display of FIGS. 3A and 3B.

FIG. 5A illustrates a simplified view of the red vs. black road chart 500 within the roulette game display 300. The red vs. black road chart 500 of FIG. 5A includes a grid 560 comprising a plurality of columns 564. The plurality of columns 564 includes a first column 574 and a last column 572 located opposite the first column 574 on the grid 560. The embodiment of FIG. 5A includes twenty columns 564. It should be appreciated that other embodiments may include a different number of columns 564.

The red vs. black road chart 500 also includes a plurality of rows 566, substantially perpendicular to the plurality of columns 564. The plurality of rows 566 includes a first row 570 and a last row 568 opposite the first row 570 on the grid 560. The embodiment of FIG. 5A includes six rows 566. It should be appreciated that other embodiments may include a different number of rows 566.

The red vs. black road chart 500 further includes a plurality of indicator spaces 562 at the intersections of each of the plurality of rows 566 and the plurality of columns 564. Each of the plurality of indicator spaces 562 is capable of displaying, at any given time, one of a red indicator 576, a black indicator 578, and a zero (or green) indicator 580, as show in FIG. 5B.

Figure 5B:
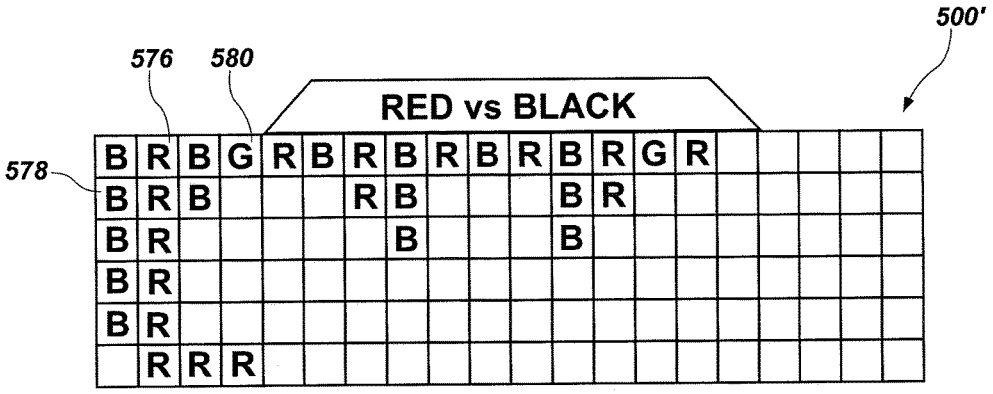
FIG. 5B is a plan view of the red vs. black road chart of FIG. 5A populated with an example of historical game play information.
Figure 5C:
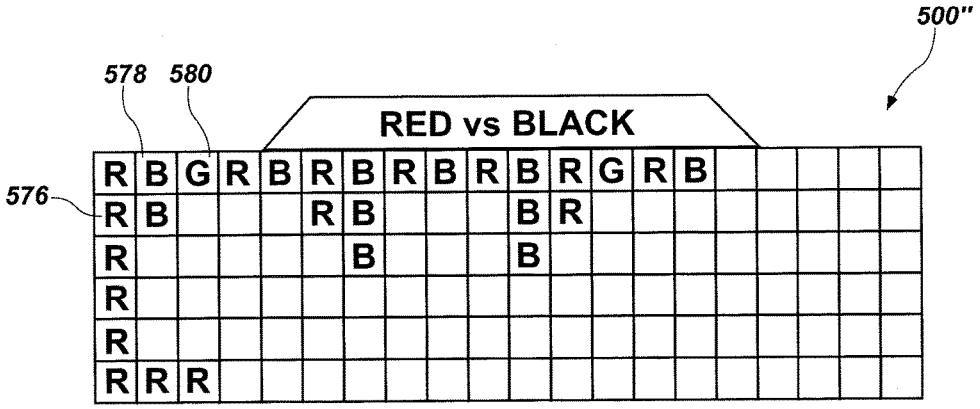
FIG. 5C is a plan view of the red vs. black road chart of FIG. 5B incremented forward by a hypothetical single spin of a roulette wheel.

Responsive to an initial spin of the roulette wheel 100 resulting in a red pocket 104, the red vs. black road chart 500 is configured to display the red indicator 576 in an initial indicator space of the plurality of indicator spaces 562 located at the intersection of the first row 570 and the first column 574 (see FIG. 5C). It should be appreciated that in other embodiments, the present disclosure contemplates location of the initial indicator space at a different location in the grid 560.

Responsive to the initial spin of the roulette wheel 100 resulting in a black pocket 106, the red vs. black road chart 500 is configured to display the black indicator 578 in the initial indicator space (see FIG. 5B). Also, responsive to an initial spin of the roulette wheel 100 resulting in the zero pocket 108 or the double zero pocket 110, the red vs. black road chart 500 is configured to display the zero indicator 580 in the initial indicator space (not shown).

Responsive to any of a plurality of subsequent spins of the roulette wheel 100, one of the red indicator 576, the black indicator 578, and the zero indicator 580 is displayed in a subsequent indicator space (not shown) of the plurality of indicator spaces 562. In the illustrated embodiment, this subsequent indicator space 562 is directly below the initial indicator space 562. If the indicator to be displayed in the subsequent indicator space 562 is the same as a preceding indicator (not shown), then the subsequent indicator space 562 is either located below, or when the lowest indicator space 562 in a column is filled, directly to the right of the last indicator. In other words, trends of sequential reds or sequential blacks are shown in each column, and if a trend continues after a column 574 is filled, that "column" may bend and continue to trend toward the right, horizontally.

If, however, the indicator to be displayed in the subsequent indicator space is not the same as the preceding indicator, the subsequent indicator space is located in the first row 570 and in the closest column of the plurality of columns 564 to the first column 574 that has an empty indicator space of the plurality of indicator spaces 562 at its intersection with the first row 570. In other words, when the sequence of spins shifts between color, population of the red vs. black road chart 500 moves to the next column in the right direction. The column being populated may remain constant in the black road chart 500, and when a new column is to be populated, the historical data shown in the black road chart 500 may shift to the left, such that the left most column is removed. In this manner, the information in the chart is continuously populated with new historical information.

FIG. 5B illustrates a simplified view of a populated red vs. black road chart 500' within a display of one or more embodiments of the current disclosure. The populated red vs. black road chart 500' shows the outcome of thirty-three spins of a roulette wheel 100. In the red vs. black road chart 500' the red indicators 576 are shown with a letter "R," the black indicators 578 are shown with a letter "B," and the zero indicators 580 are shown with a letter "G." In other embodiments, the red indicators 576, the black indicators 578, and the zero indicators 580 are shown with other indicating symbols or patterns, such as a red square, a black square, and a green square, respectively. Any other indicators identifying red, black and zero may be used in yet other embodiments.

The least recent five spin results shown in the first column 574 in the red vs. black road chart 500' of FIG. 5B indicate that all five least recent spins resulted in black pockets 106. The red vs. black road chart indicates that the eight subsequent spins each resulted in red pockets 104, which exceeds the number of rows 566. In the embodiment of FIG. 5B, where the preceding indicator space is located in the last row 568 and the subsequent indicator is the same as that displayed in the preceding indicator space, the subsequent indicator space may be located in the empty column of the plurality of columns 564 adjacent to the preceding indicator space and in the last row 568. The result, as seen in the second column of the plurality of columns 564 is that after a column of the plurality of columns 564 fills up, it may populate toward the last column 572 in the last row 568 along the bottom row of the black road chart 500.

In other embodiments, instead of trending toward the last column 572, the subsequent indicator may be displayed in the first row 570 of the next empty column of the plurality of columns 564. In still other embodiments, once a column of the plurality of columns 564 fills, subsequent indicators may not be displayed until a spin results in a different pocket corresponding to a different indicator than displayed in the previous indicator space.

An observation readily apparent from FIG. 5B is that when populated, each of the plurality of columns 564 contains only one type of indicator, that is either the red indicator 576, the black indicator 578, or the zero indicator 580. Areas not populated towards the last column 572 contain no indicators.

FIG. 5C illustrates a simplified view of the populated red vs. black road chart 500' of FIG. 5B incremented forward seven spins from FIG. 5B. In this embodiment, a maximum of fifteen (15) columns 574 are populated during the game. As is apparent from the seven-spin incremented red vs. black road chart 500", the most recent spin resulted in a black pocket. It is also apparent from FIG. 5C that all the indicators populating the indicator spaces 562 shifted toward the first column 574, and the indicators populating the first column 574 were removed. In the embodiment of FIG. 5C, the grid 560 is configured to shift responsive to filling responsive to a game result after fifteen columns of the plurality of columns 564 have been filled.

In other embodiments, the indicators may be allowed to occupy every column of the plurality of columns 564 before shifting. In yet other embodiments, the entire grid 560 may be cleared after the grid 560 fills, after which the grid may again be populated beginning in an initial indicator space.

Figure 6A:
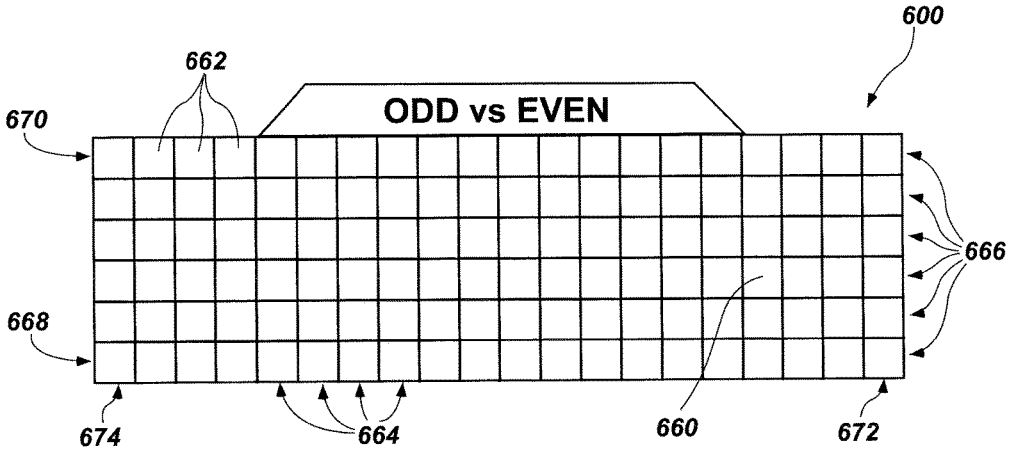
FIG. 6A is a plan view of an unpopulated odd vs. even road chart that may be displayed on a portion of the roulette game display of FIGS. 3A and 3B.

FIG. 6A illustrates a simplified view of the odd vs. even road chart 600 within the roulette game display 300. The odd vs. even road chart 600 may be substantially similar to the red vs. black chart, and may populate in substantially the same manner with historical game play information. The odd vs. even road chart 600 of FIG. 6A includes a grid 660 comprising a plurality of columns 664. The plurality of columns 664 includes a first column 674 and a last column 672 located opposite the first column 674 on the grid 660. The embodiment of FIG. 6A includes twenty columns 664. It should be appreciated that other embodiments may include a different number of columns 664.

The odd vs. even road chart 600 also includes a plurality of rows 666, substantially perpendicular to the plurality of columns 664. The plurality of rows 666 includes a first row 670 and a last row 668 opposite the first row 670 on the grid 660. The embodiment of FIG. 6A includes six rows 666. It should be appreciated that other embodiments may include a different number of rows 666.

The odd vs. even road chart 600 further includes a plurality of indicator spaces 662 at the intersections of each of the plurality of rows 666 and the plurality of columns 664. Each of the plurality of indicator spaces 662 is capable of displaying, at any given time, one of an odd indicator 676, an even indicator 678, and a zero (or green) indicator 680.

Responsive to an initial spin of the roulette wheel 100 resulting in an odd-numbered pocket, the odd vs. even road chart 600 is configured to display the odd indicator 676 in an initial indicator space (not shown). In some embodiments, the initial indicator may be located at the intersection of the first row 670 and the first column 674. In other embodiments, the initial indicator may be located at a different indicator space of the plurality of indicator spaces 662.

Responsive to an initial spin of the roulette wheel 100 resulting in an even-numbered pocket, the odd vs. even road chart 600 is configured to display the even indicator 678 in the initial indicator space 662. Also, responsive to an initial spin of the roulette wheel 100 resulting in the zero pocket 108 or the double zero pocket 110, the odd vs. even road chart 600 is configured to display the green zero indicator 680 in the initial indicator space 662.

Responsive to each of a plurality of subsequent spins of the roulette wheel 100, one of the odd indicator 676, the even indicator 678, and the zero indicator 680 that corresponds to a subsequent spin is displayed in a subsequent indicator space (not shown). If the indicator to be displayed in the subsequent indicator space 662 is the same as a preceding indicator (not shown), then the subsequent indicator space 662 is located directly beneath the last indicator of the same type, or if the lowest space in that column 674 is taken, to the right of that indicator space 662. In other words, trends of sequential evens or sequential odds are shown in each column, and if a trend continues after a column 674 is filled, that "column" may bend and continue to trend toward the right, horizontally.

If, however, the indicator to be displayed in the subsequent indicator space is not the same as the preceding indicator, the subsequent indicator space is located in the first row and in a column of the plurality of columns 664 that is both closest to the first column that has an empty indicator space at its intersection with the first row 670. In other words, when the sequence of spins shifts between evens and odds, population of the odd vs. even road chart 600 moves to the next column in the right direction. The column being populated may remain constant in the even road chart 600, and when a new column is to be populated, the historical data shown in the even road chart 600 may shift to the left, such that the left most column is removed. In this manner, the information in the chart is continuously populated with new historical information.

Figure 6B:
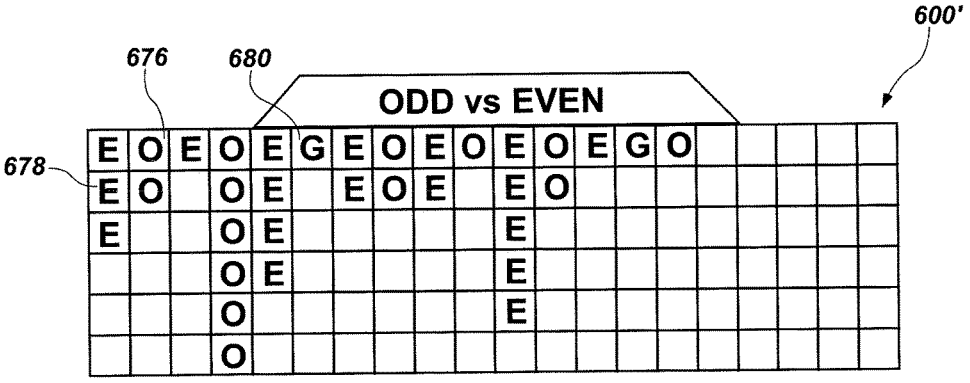
FIG. 6B is a plan view of the odd vs. even road chart of FIG. 6A populated with an example of historical game play information.

FIG. 6B illustrates a simplified view of a populated odd vs. even road chart 600' within the roulette game display 300 of one or more embodiments of the current disclosure. The populated odd vs. even road chart 600' shows the outcome of thirty-four spins of a roulette wheel 100. In the populated odd vs. even road chart 600' the odd indicators 676 are shown with a letter "O," the even indicators 678 are shown with a letter "E," and the zero indicators 680 are shown with a letter "G." Any other indicators identifying odd, even and zero may be used in yet other embodiments.

The least recent three spin results shown in the first column 674 in the populated odd vs. even road chart 600' of FIG. 6B indicate that at three least recent spins resulted in even-numbered pockets. The populated odd vs. even road chart 600' indicates that the two subsequent spins both resulted in odd pockets. None of the plurality of columns 664 is filled beyond capacity, so populating the last column 672 does not occur in FIG. 6B. It will be appreciated, however, that the disclosure contemplates such population of the last column 672, as described above with respect to FIG. 5B.

Figure 6C:
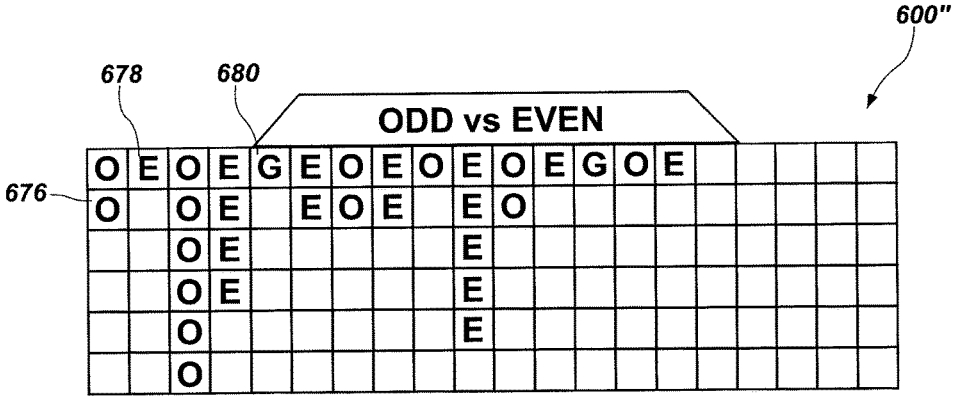
FIG. 6C is a plan view of the populated odd vs. even road chart of FIG. 6B incremented forward by a hypothetical single spin of a roulette wheel.

An observation readily apparent from FIG. 6B is that when populated, each column of the plurality of columns 664 includes only one type of indicator, that is either the odd indicator 676, the even indicator 678, or the zero indicator 680. Areas not populated towards the last column 672 contain no indicators FIG. 6C illustrates a simplified view of the populated odd vs. even road chart 600' of FIG. 6B incremented forward one spin. As is apparent from the one-spin incremented odd vs. even road chart 600', the most recent spin resulted in an even-numbered pocket. It is also apparent from FIG. 6C that all the indicators populating the indicator spaces 662 shifted toward the first column 674, and the indicators populating the first column 674 were removed. In the embodiment of FIG. 6C, the grid 660 is also configured to shift to the left toward the first column 674 responsive to filling past a predetermined maximum number of columns, for example fifteen columns of the plurality columns 664.

In other embodiments, the indicators may be allowed to occupy every column of the plurality of columns 664 before shifting. In yet other embodiments, the entire grid 660 may be cleared after the grid 660 fills, after which the grid may again be populated beginning in an initial indicator space.

Figure 7A:
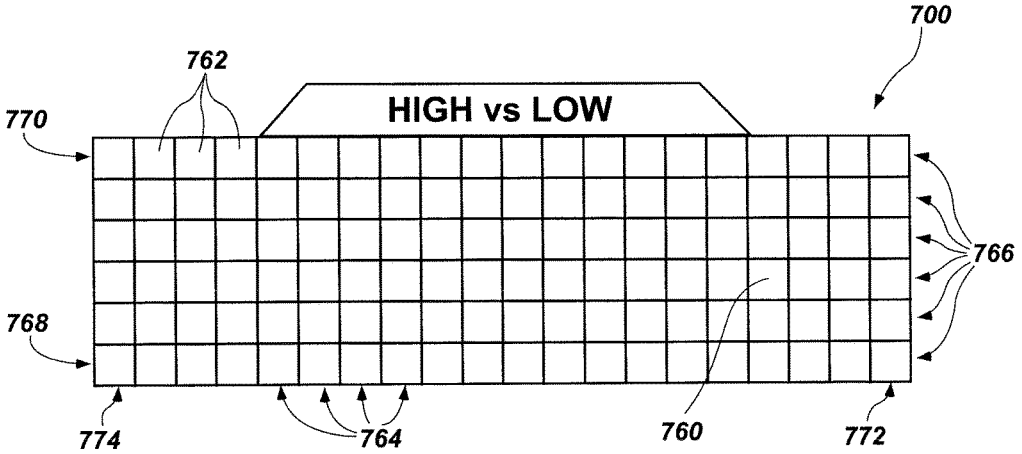
FIG. 7A is a plan view of an unpopulated high vs. low road chart that may be displayed on a portion of the roulette game display of FIGS. 3A and 3B.

FIG. 7A illustrates a simplified view of a high vs. low road chart 700 within the roulette game display 300. The odd vs. even road chart 600 may be substantially similar to the red vs. black road chart 500, and may populate in substantially the same manner with historical game play information. The high vs. low road chart 700 of FIG. 7A includes a grid 760 comprising a plurality of columns 764. The plurality of columns 764 includes a first column 774 and a last column 772 located opposite the first column 774 on the grid 760. The embodiment of FIG. 7A includes twenty columns 764. It should be appreciated that other embodiments may include a different number of columns 764.

The high vs. low road chart 700 also includes a plurality of rows 766, substantially perpendicular to the plurality of columns 764. The plurality of rows 766 includes a first row 770 and a last row 768 opposite the first row 770 on the grid 760. The embodiment of FIG. 7A includes six rows 766. It should be appreciated that other embodiments may include a different number of rows 766.

The high vs. low road chart 700 further includes a plurality of indicator spaces 762 at the intersections of each of the plurality of rows 766 and the plurality of columns 764. Each of the plurality of indicator spaces 762 is capable of displaying, at any given time, one of a high indicator 776, a low indicator 778, and a zero (or green) indicator 780. Responsive to an initial spin of the roulette wheel 100 resulting in a high-numbered pocket, the high vs. low road chart 700 is configured to display the high indicator Δ776 in an initial indicator space (not shown) of the plurality of indicator spaces 762. The initial indicator space may be located at the intersection of the first row 770 and the first column 774. In other embodiments, the initial indicator space may be located in a different indicator space of the plurality of indicator spaces 762.

Responsive to an initial spin of the roulette wheel 100 resulting in a low-numbered pocket, the high vs. low road chart 700 is configured to display the low indicator ∇778 in the initial indicator space. Also, responsive to an initial spin of the roulette wheel 100 resulting in the zero pocket 108 or the double zero pocket 110, the high vs. low road chart 700 is configured to display the zero indicator 780 in the initial indicator space.

Responsive to any of a plurality of subsequent spins of the roulette wheel 100, one of the high indicator 776, the low indicator 778, and the zero indicator 780 is displayed in a subsequent indicator space (not shown). If the indicator to be displayed in the subsequent indicator space is the same as a preceding indicator (not shown), then the subsequent indicator space is located at the intersection of the same column of the plurality of columns 764 as the preceding indicator space and a row of the plurality of rows 766 that is both adjacent to the preceding indicator space and between the preceding indicator space and the last row 768. In other words, trends of sequential highs or sequential lows are shown in each column.

If, however, the indicator to be displayed in the subsequent indicator space is not the same as the preceding indicator, the subsequent indicator space is located in the first row 770 and in a column of the plurality of columns 764 that is both closest to the first column 774 and has an empty indicator space at its intersection with the first row 770. In other words, when the sequence of spins shifts between highs and lows, population of the high vs. low road chart 700 moves to the next column in the right direction. The column being populated may remain constant in the chart low road 700, and when a new column is to be populated, the historical data shown in the low road chart 700 may shift to the left, such that the left most column is removed. In this manner, the information in the chart is continuously populated with new historical information.

Figure 7B:
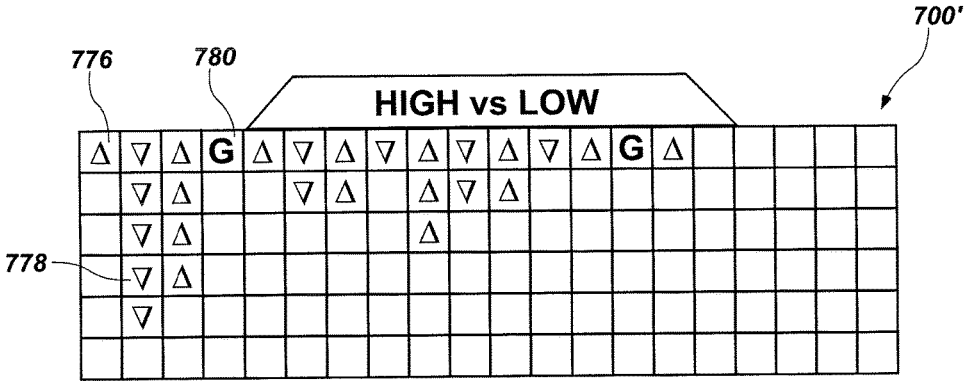
FIG. 7B is a plan view of the high vs. low road chart of FIG. 7A populated with an example of historical game play information.

FIG. 7B illustrates a simplified view of a populated high vs. low road chart 700' within a roulette game display 300 of one or more embodiments of the current disclosure. The populated high vs. low road chart 700' shows the outcome of twenty-eight spins of a roulette wheel 100. In the populated high vs. low road chart 700' the high indicators 776 are shown with an upward directed arrow, the low indicators 778 are shown with a downward directed arrow, and the zero indicators 780 are shown with a letter "G." Any other indicators identifying high, low and zero may be used in yet other embodiments.

The least recent spin result shown in the first column 774 in the populated high vs. low road chart 700' of FIG. 7B indicates that the least recent spin resulted in a high-numbered pocket. The populated high vs. low road chart 700' also indicates that the five subsequent spins each resulted in low-numbered pockets. None of the plurality of columns 764 is filled beyond capacity, so no population towards the last column 772 manifests itself in FIG. 7B. It will be appreciated, however, that the current disclosure contemplates such population towards the last column 772, as described above with respect to FIG. 5B.

An observation apparent from FIG. 7B is that when populated, each column of the plurality of columns 664 includes only one of the high indicator 776, the low indicator 778, and the zero indicator 780, except the columns that remain unpopulated.

Figure 7C:
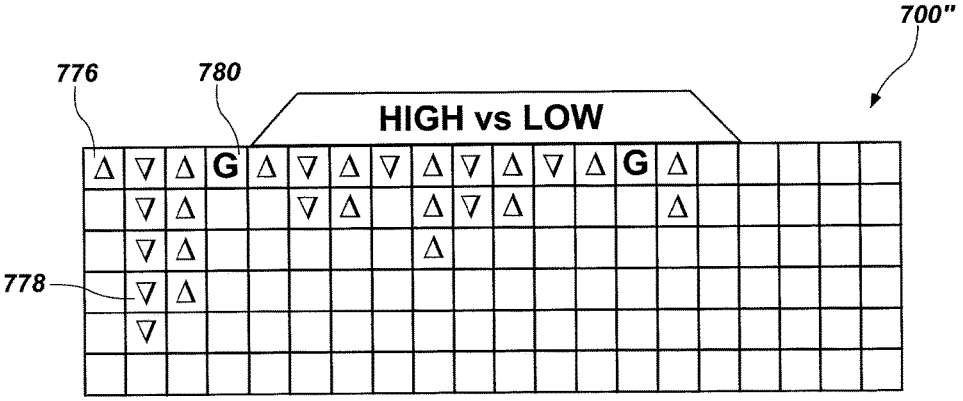
FIG. 7C is a plan view of the populated high vs. low road chart of FIG. 7B incremented forward by a hypothetical single spin of a roulette wheel.

FIG. 7C illustrates a simplified view of the populated high vs. low road chart 700' of FIG. 7B after an additional spin. As is apparent from the one-spin modified high vs. low road chart 700", the most recent spin resulted in a high-numbered pocket. It is also apparent from FIG. 7C that none of the indicators populating the indicator spaces 762 shifted toward the first column 774 since the most recent spin did not require displaying an indicator in a new column of the plurality of columns 764 and all, or a predetermined number of columns 764 have already been filled. It will be appreciated, however, that the present disclosure contemplates such shifting, as described with reference to FIG. 5C.

The road charts of FIGS. 5A through 7C, of course, could also be populated in vertical rows and horizontal columns.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being encompassed within the scope of embodiments encompassed by the disclosure as contemplated by the inventor.

What is claimed is:

1. A method of displaying information relating to a roulette game, the method comprising:

executing, with a processing element operably coupled to an electronic display, computer-readable instructions stored on a non-transitory computer-readable medium operably coupled to the processing element, the computer-readable instructions configured to instruct the processing element to:

display, on the electronic display, a grid comprising a plurality of indicator spaces arranged in a plurality of horizontal lines and a plurality of vertical lines, the plurality of horizontal lines comprising a first horizontal line and a last horizontal line, the plurality of vertical lines comprising a first vertical line and a last vertical line;

display an initial indicator in an initial indicator space of the plurality of indicator spaces, the initial indicator corresponding to one of a first indicator and a second indicator, the first indicator signaling a first winning bet of even money bets of a roulette game, and the second indicator signaling a second different winning bet of the even money bets; and display a subsequent indicator in a subsequent indicator space, the subsequent indicator corresponding to a subsequent winning bet of the even money bets of the roulette game, the subsequent indicator space located:

in a vertical line of the initial indicator space and adjacent the initial indicator space if the subsequent indicator is the same as the initial indicator and an indicator space is available below the initial indicator space;

in a vertical line adjacent to the vertical line of the initial indicator space and in the last horizontal line if the subsequent indicator is the same as the initial indicator and the initial indicator space is in the last horizontal line; and in the vertical line adjacent to the vertical line of the initial indicator space and in the first horizontal line if the subsequent indicator is different than the initial indicator.

2. The method of claim 1, wherein the even money bet is a red vs. black bet, the first indicator represents a red winning bet, and the second indicator represents a black winning bet.

3. The method of claim 1, wherein the even money bet is an odd vs. even bet, the first indicator represents an odd winning bet, and the second indicator represents an even winning bet.

4. The method of claim 1, wherein the even money bet is a high vs. low bet, the first indicator represents a high winning bet, and the second indicator represents a low winning bet.

5. The method of claim 1, wherein displaying an initial indicator and displaying a subsequent indicator comprises displaying a third indicator, the third indicator signaling at least one of a zero winning bet and a double zero winning bet.

6. The method of claim 1, further comprising shifting all indicators in the plurality of indicator spaces one or more indicator spaces toward the first vertical line such that at least one vertical line of the plurality of vertical lines is empty and the indicators in the first vertical line just prior to the shift are not displayed.

7. The method of claim 6, further comprising determining if a predetermined number of the plurality of vertical lines have one or more indicators.

8. The method of claim 7, wherein the predetermined number is equal to fifteen (15).

9. The method of claim 6, further comprising determining if a predetermined vertical line of the plurality of vertical lines has one or more indicators.

10. An apparatus for displaying information relating to a roulette game, comprising a processing element operably coupled to an electronic display and a non-transitory computer-readable medium, the non-transitory computer-readable medium including computer-readable instructions configured to instruct the processing element to display, on the electronic display, a grid comprising:

a plurality of indicator spaces arranged in a plurality of horizontal lines and a plurality of vertical lines, the plurality of horizontal lines including a first horizontal line and a last horizontal line, the plurality of vertical lines including a first vertical and a last vertical line, each of the plurality of indicator spaces configured to display a plurality of indicators corresponding to a plurality of winning bets in a roulette game, a first indicator corresponding to a first bet of even money bets, and a second indicator corresponding to a second bet of the even money bets;

wherein the grid is configured to:

display an initial indicator in an initial indicator space, the initial indicator comprising one of the first indicator and the second indicator, and the initial indicator corresponding to an initial winning bet of the even money bet of an initial spin of a roulette wheel; and display a subsequent indicator in a subsequent indicator space, the subsequent indicator corresponding to a subsequent winning bet, the subsequent indicator space located:

in a vertical line of the initial indicator space and adjacent the initial indicator space if the subsequent indicator is the same as the initial indicator and an indicator space is available below the initial indicator space;

in a vertical line adjacent to the vertical line of the initial indicator space and in the last horizontal line if the subsequent indicator is the same as the initial indicator and the initial indicator space is in the last horizontal line; and in the vertical line adjacent to the vertical line of the initial indicator space and in the first horizontal line if the subsequent indicator is different than the initial indicator.

11. The apparatus of claim 10, wherein the first indicator indicates a red result and the second indicator indicates a black result.

12. The apparatus of claim 10, wherein the first indicator indicates an odd result and the second indicator indicates an even result.

13. The apparatus of claim 10, wherein the first indicator indicates a high result and the second indicator indicates a low result.

14. A display device for displaying information relating to a roulette game, comprising control circuitry operably coupled to an electronic display, the control circuitry including a non-transitory computer-readable medium operably coupled to a processing element, the computer-readable medium including computer-readable instructions, the processing element configured to execute the computer-readable instructions, the computer-readable instructions configured to instruct the processing element to display, on the electronic display, a field including an arrangement of indicator spaces, each of the indicator spaces including a number corresponding to a number on a roulette wheel, wherein:

the number included by each indicator space is different from the number included by each of the other indicator spaces;

the indicator spaces including numbers corresponding to a plurality of results of a predetermined number of spins of the roulette wheel are marked to indicate the plurality of results;

the indicator spaces are marked by displaying a number of stackable indicator spaces, the number of stackable indicator spaces marking one of the indicator spaces equivalent to a number of results of the plurality of results that include the number of the one of the indicator spaces; and a top stackable indicator space stacked on the one of the indicator spaces displays the number of the one of the indicator spaces.

15. The display device of claim 14, wherein the arrangement of indicator spaces is arranged in a roulette betting table layout, the arrangement of indicator spaces further configured for marking by locating a plurality of markers on the indicator spaces that match the plurality of results corresponding to the predetermined number of spins.

16. The display device of claim 14, wherein the arrangement of indicator spaces comprises a racetrack configuration, the racetrack configuration comprising the indicator spaces arranged in an elongated ring.

17. A method of displaying information relating to a roulette game, the method comprising:

executing, with a processing element operably coupled to an electronic display, computer-readable instructions stored on a non-transitory computer-readable medium operably coupled to the processing element, the computer-readable instructions configured to instruct the processing element to:

display a plurality of indicator spaces in a field of the electronic display, each of the plurality of indicator spaces displaying a number corresponding to a number on a roulette wheel, wherein the number included by each indicator space of the plurality is different from the number included by each of the other indicator spaces of the plurality;

store a plurality of results corresponding to a plurality of spins of a roulette wheel on a storage device; and mark each of the plurality of indicator spaces that correspond to the plurality of results by displaying a stackable indicator space for each result of the plurality of results, the stackable indicator space stacked on the one of the plurality of indicator spaces that corresponds to the result, wherein a top stackable indicator space stacked on the one of the plurality of indicator spaces displays the number of the one of the plurality of indicator spaces; and wherein displaying a plurality of indicator spaces comprises arranging the plurality of indicator spaces such that there is one-to-one correspondence between the plurality of indicator spaces and a plurality of numbered roulette betting spaces in a roulette betting table.

18. An apparatus for displaying information relating to a roulette game, comprising a processing element operably coupled to an electronic display and a non-transitory computer-readable medium, the non-transitory computer-readable medium including computer-readable instructions configured to instruct the processing element to display, on the electronic display:

indicator spaces arranged in rows and columns, each of the indicator spaces configured to display an indicator comprising one of a first indicator corresponding to a first winning bet of even money bets, and a second indicator corresponding to a second winning bet of the even money bets;

wherein a preceding indicator space of the indicator spaces is configured to display a one of the first indicator and the second indicator that corresponds to a preceding result of a preceding spin of a roulette wheel; and wherein a next indicator spaces is configured to display a one of the first indicator and the second indicator that corresponds to a next result of a next spin of the roulette wheel, the next indicator space located:

in a column of the preceding indicator space and adjacent the preceding indicator space if the next result is the same as the preceding result and an indicator space is available below the preceding indicator space;

in a column adjacent to the column of the preceding indicator space and in a last row if the next result is the same as the preceding result and the preceding indicator space is in the last row; and in the column adjacent to the column of the preceding indicator space and in a first row if the next result is different than the preceding result.

19. The apparatus of claim 18, wherein the computer-readable instructions are further configured to instruct the processing element to:

display, on the electronic display, a field including an arrangement of other indicator spaces, each of the other indicator spaces including a number corresponding to a number on a roulette wheel; and mark the other indicator spaces to indicate a plurality of results corresponding to a predetermined number of spins of the roulette wheel.

20. The apparatus of claim 19, wherein the other indicator spaces are marked by locating a marker for each of the plurality of results next to a corresponding other indicator space of the arrangement of other indicator spaces.

21. A method of displaying information relating to a roulette game, the method comprising:

executing, with a processing element operably coupled to an electronic display, computer-readable instructions stored on a non-transitory computer-readable medium operably coupled to the processing element, the computer-readable instructions configured to instruct the processing element to:

display indicator spaces arranged in rows and columns, the rows comprising a first row and a last row; and indicate a next winning even money bet corresponding to a next spin of a roulette wheel:

in a same one of the columns as an indication of a preceding winning even money bet corresponding to a preceding spin of the roulette wheel if the next winning even money bet corresponds to a same winning even money bet as the preceding winning even money bet and the indication of the preceding winning even money bet is not in the last row;

in the last row and adjacent to the indication of the preceding winning even money bet if the next winning even money bet corresponds to the same winning even money bet as the preceding winning even money bet and the indication of the preceding winning even money bet is in the last row; and in the first row and a next empty one of the columns if the next winning even money bet corresponds to a different winning even money bet than the preceding winning even money bet.

22. The method of claim 21, wherein the computer-readable instructions are further configured to instruct the processing element to:

display a plurality of other indicator spaces on the electronic display, each of the plurality of other indicator spaces displaying a number corresponding to a number on the roulette wheel;

store a plurality of results corresponding to a plurality of spins of the roulette wheel on a storage device; and mark each of the plurality of other indicator spaces that corresponds to the plurality of results.

23. The method of claim 22, wherein displaying the plurality of other indicator spaces on the electronic display comprises arranging the plurality of other indicator spaces in a shape of a racetrack.

24. The method of claim 22, wherein marking each of the plurality of other indicator spaces comprises locating a marker next to each of the plurality of other indicator spaces that correspond to the plurality of results.

* * * * *